US007146646B2

(12) United States Patent
Grilliot et al.

(10) Patent No.: US 7,146,646 B2
(45) **Date of Patent: *Dec. 12, 2006**

(54) PROTECTIVE METHOD USING REVERSIBLE GARMENT FOR MILITARY OR PARAMILITARY FIREFIGHTER

(75) Inventors: William L. Grilliot, Dayton, OH (US); Mary I. Grilliot, Dayton, OH (US); Patricia Lewis, Huber Heights, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/782,273

(22) Filed: Feb. 19, 2004

(65) Prior Publication Data

US 2006/0195963 A1 Sep. 7, 2006

Related U.S. Application Data

(63) Continuation of application No. 10/350,862, filed on Jan. 24, 2003, now abandoned.

(51) Int. Cl.
*A41D 13/00* (2006.01)

(52) U.S. Cl. ..... 2/93; 2/458; 2/DIG. 2

(58) Field of Classification Search ..... 2/81, 2/97, 424, 442, 458, 467, 69, 69.5, 85–94, 2/102, 108, 115, 244, 900, DIG. 2
See application file for complete search history.

(56) References Cited

U.S. PATENT DOCUMENTS

| | | | | |
|---|---|---|---|---|
| 238,945 A | | 3/1881 | Marks | |
| 1,052,475 A | | 2/1913 | Friedman | |
| 1,224,704 A | | 5/1917 | Berger | |
| 1,648,250 A | | 11/1927 | Woislawsky | |
| 1,914,236 A | | 6/1933 | Berkwits | |
| 1,971,682 A | | 8/1934 | Hoch | |
| 2,138,041 A | | 11/1938 | Preston | |
| 2,174,831 A | | 10/1939 | Muller | |
| 2,711,539 A | | 6/1955 | Loscher | |
| 3,018,486 A | | 1/1962 | Bukspan | |
| 3,837,007 A | * | 9/1974 | Girest | 359/519 |
| 4,103,361 A | | 8/1978 | Carmen | |
| 4,338,686 A | | 7/1982 | Bell | |
| 4,365,354 A | * | 12/1982 | Sullivan | 2/247 |
| 4,472,835 A | | 9/1984 | Clark | |

(Continued)

OTHER PUBLICATIONS

NFPA 1971 Standard on Protective Emsemble for Structural Fire Fighting 2000 Edition, NFPA, 1 Batterymarch Park, Quincy MA 02169 7471, An International Codes and Standards Organization, pp. 1971-6 through pp. 1971-28.*

*Primary Examiner*—Alissa L. Hoey
(74) *Attorney, Agent, or Firm*—Wood, Phillips, Katz, Clark & Mortimer

(57) ABSTRACT

Being reversible, a protective garment for a military or paramilitary firefighter or emergency worker has a shell of high visibility and a shell of low visibility. The shell of high visibility has portions that are reflective, fluorescent, or both, which the shell of low visibility does not have. When facing outwardly, the shell of low visibility appears black, or at least dark, in ambient light or displays camouflage. Except that the shell of low visibility does not have any reflective or fluorescent portions, the shells conform to National Fire Protection Association (NFPA) standards for outer shells of protective garments for firefighters. The shells are equal, or at least similar, in basis weights.

14 Claims, 1 Drawing Sheet

U.S. PATENT DOCUMENTS 4,774,725 A 10/1988 Page
5,029,344 A 7/1991 Sharman et al.
5,040,243 A 8/1991 Tatsuno
5,043,202 A 8/1991 Knickerbocker
5,054,125 A 10/1991 Snedeker
5,189,737 A 3/1993 Ribicic
5,561,860 A * 10/1996 Nguyen-Senderowicz ..... 2/90
5,675,838 A * 10/1997 Hollinger ..... 2/69
5,799,329 A * 9/1998 Hauschild ..... 2/102
5,884,332 A 3/1999 Snedeker
5,933,865 A 8/1999 Aldridge
6,009,560 A * 1/2000 McKenney et al. ..... 2/244
6,128,783 A * 10/2000 Blauer et al. ..... 2/90
6,272,688 B1 * 8/2001 Wilson ..... 2/170
6,345,393 B1 2/2002 Bayer
6,421,834 B1 7/2002 Kester
6,523,180 B1 * 2/2003 Christopher ..... 2/59
6,550,066 B1 4/2003 Brassey
6,728,970 B1 * 5/2004 Grilliot et al. ..... 2/81
6,892,394 B1 * 5/2005 Grilliot et al. ..... 2/81
2002/0016985 A1 * 2/2002 Kelleher et al. ..... 2/458
2002/0083507 A1 * 7/2002 Mullis ..... 2/94
2004/0143882 A1 * 7/2004 Gardner et al. ..... 2/81

* cited by examiner

PROTECTIVE METHOD USING REVERSIBLE GARMENT FOR MILITARY OR PARAMILITARY FIREFIGHTER

CROSS-REFERENCE TO RELATED APPLICATION

This application is a continuation of U.S. patent application Ser. No. 10/350,862, which was filed on Jan. 24, 2003.

TECHNICAL FIELD OF THE INVENTION

This invention pertains to a protective garment for a firefighter or emergency worker, particularly a military or paramilitary firefighter or emergency worker. This invention contemplates that the protective garment is reversible so as to expose, as an outer shell, either a shell of high visibility or a shell of low visibility.

BACKGROUND OF THE INVENTION

Protective garments for firefighters and emergency workers include coats, trousers, overalls, and coveralls. Currently, National Fire Protection Association (NFPA) standards require a protective garment for a firefighter to have reflective trim, which enhances the visibility of the protective garment and, therefore, the visibility of its wearer under smoke-laden and other adverse conditions. Generally, reflective trim is affixed by sewing, adhesively, or otherwise.

However, for a military or paramilitary firefighter or emergency worker operating where a tactical operation has developed or is expected to develop, a need for low visibility may override a need for high visibility. Heretofore, a military or paramilitary firefighter or emergency worker may have to be issued two types of protective garments, i.e., protective garments to be worn in a tactical operation, in which the need for low visibility overrides the need for high visibility, and protective garments to be worn otherwise.

SUMMARY OF THE INVENTION

This invention provides a protective garment for a military or paramilitary firefighter or emergency worker. Being reversible, the protective garment has a shell of high visibility and a shell of low visibility. The protective garment is wearable with either shell facing outwardly. The shell of high visibility has portions that are reflective, fluorescent, or both, which the shell of low visibility does not have. Those portions, which face outwardly when the protective garment is worn so that the shell of high visibility faces outwardly, may be provided by reflective trim affixed by sewing, adhesively, or otherwise to the shell of high visibility. Preferably, when facing outwardly, the shell of low visibility appears black, or at least dark, in ambient light. Alternatively, when facing outwardly, the shell of low visibility displays camouflage.

Preferably, except that the shell of low visibility does not have reflective trim or any reflective or fluorescent portions, the shells conform to National Fire Protection Association (NFPA) standards for outer shells of protective garments for firefighters. Preferably, moreover, the shells are equal, or at least similar, in basis weights.

DETAILED DESCRIPTION OF THE ILLUSTRATED EMBODIMENT

Figure 1:
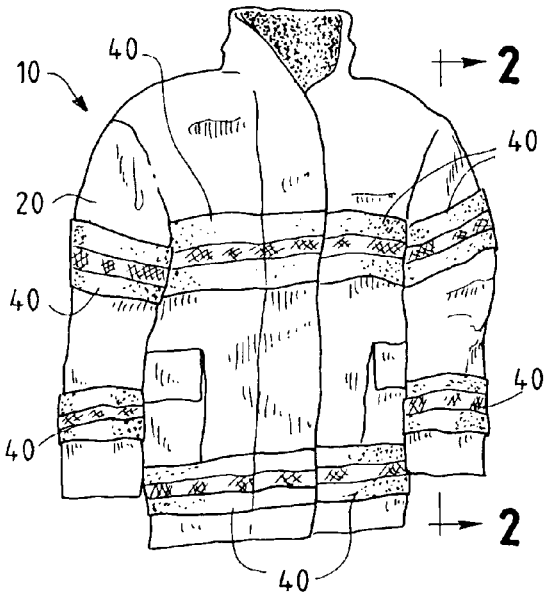
FIG. 1 is a front elevation of a protective coat embodying this invention, as worn with its shell of high visibility facing outwardly.
Figure 2:
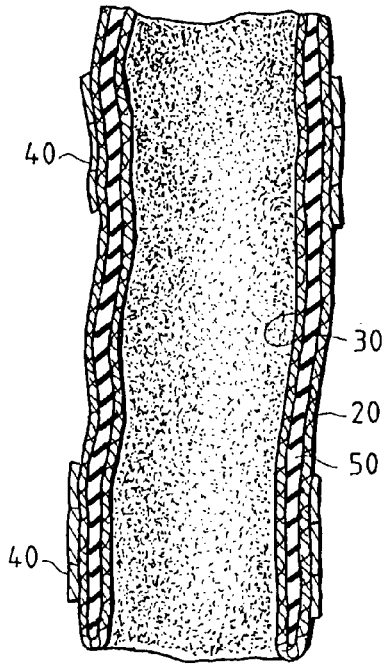
FIG. 2 is a front elevation of the same coat, as worn with its shell of low visibility facing outwardly.
Figure 3:
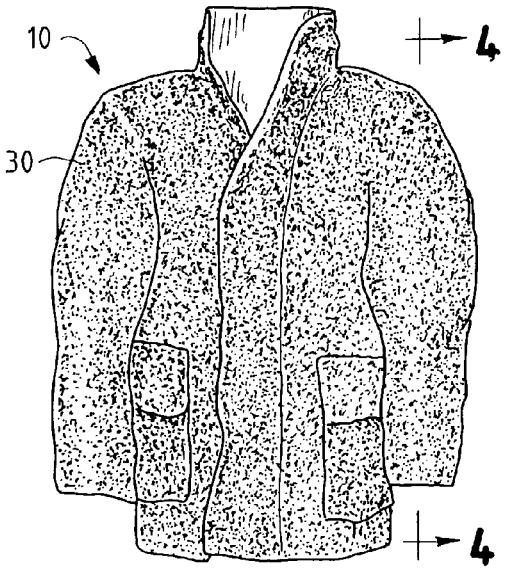
FIGS. 3 and 4 are cross-sections, as taken respectively along line 3—3 of FIG. 1 and along line 4—4 of FIG. 2, in directions indicated by arrows.
Figure 4:
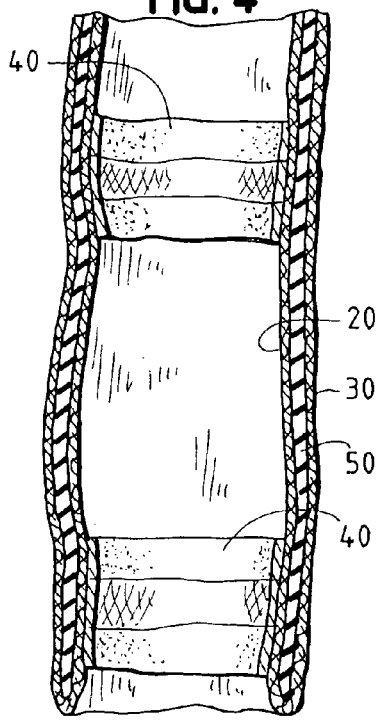

As illustrated, a protective coat 10 for a military or paramilitary firefighter or emergency worker embodies this invention and has a shell 20 of high visibility and a shell 30 of low visibility. As contemplated by this invention, the shell 20 of high visibility has several strips 40 of reflective trim, which the shell 30 of low visibility does not have. Preferably, when facing outwardly, the shell 30 of low visibility appears black, or at least dark, in ambient light. Alternatively, when facing outwardly, the shell 30 of low visibility displays camouflage.

Preferably, except that the shell 30 of low visibility does not have reflective trim, the shells conform in weight, tear strength, and other characteristics to National Fire Protection Association (NFPA) standards for outer shells of protective garments for firefighters. Preferably, moreover, the shells 20, 30, are equal, or at least similar, in basis weights. A preferred material for the shells 20, 30, is Nomex™ material having a basis weight of nine ounces (9 oz.) per square yard, as available commercially from E. I. du Pont de Nemours and Company of Wilmington, Del. Such material is available commercially in patterns that display camouflage. Scotchlite™ reflective trim is suitable, as available commercially from Minnesota Mining and Manufacturing Company of St. Paul, Minn.

As illustrated, the protective coat 10 has between the shells 20, 30, a layer 50 providing a moisture barrier. Along with the layer 50 providing the moisture barrier, another layer or other layers may be also provided between the shells 20, 30, such as a layer providing thermal insulation. Although a protective coat is illustrated, this invention may be also embodied in other protective garments, such as trousers, overalls, and coveralls.

In a tactical operation, in which the need for low visibility overrides the need for high visibility, a military or paramilitary firefighter or emergency worker may wear the protective coat 10 with the shell 30 of low visibility facing outwardly. Otherwise, the firefighter or emergency worker may wear the protective coat 10 with the shell 20 of high visibility facing outwardly. If a tactical operation develops or is expected to develop while a military or paramilitary firefighter or emergency worker is wearing the protective garment 10 with the shell 20 of high visibility facing outwardly, the firefighter or emergency worker may have an opportunity to doff the protective coat 10, reverse it, and re-don it with the shell 30 of low visibility facing outwardly.

The invention claimed is:

1. A method for protecting a military or paramilitary firefighter or emergency worker, wherein the method comprises providing the military or paramilitary firefighter or emergency worker with a protective garment, which is a coat, trousers, overalls, or coveralls, which is reversible, which has a shell of high visibility and a shell of low visibility, and which is wearable with either shell facing outwardly while the other shell faces inwardly and wherein the shell of high visibility has portions that are reflective, fluorescent, or both, which portions face outwardly when the protective garment is worn so that the shell of high visibility faces outwardly, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

2. The method of claim 1 wherein those portions are provided by reflective trim affixed to the shell of high visibility.

3. A method for protecting a military or paramilitary firefighter or emergency worker, wherein the method comprises providing the military or paramilitary firefighter or emergency worker with a protective garment, which is a coat, trousers, overalls, or coveralls, which is reversible, which has a shell of high visibility and a shell of low visibility, and which is wearable with either shell facing outwardly while the other shell faces inwardly, wherein the shell of high visibility has portions that are reflective, fluorescent, or both, which portions face outwardly when the protective garment is worn so that the shell of high visibility faces outwardly, wherein, when facing outwardly, the shell of low visibility appears dark in ambient light, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

4. A method for protecting a military or paramilitary firefighter or emergency worker, wherein the method comprises providing the military or paramilitary firefighter or emergency worker with a protective garment, which is a coat, trousers, overalls, or coveralls, which is reversible, which has a shell of high visibility and a shell of low visibility, and which is wearable with either shell facing outwardly while the other shell faces inwardly, wherein the shell of high visibility has portions that are reflective, fluorescent, or both, which portions face outwardly when the protective garment is worn so that the shell of high visibility faces outwardly, wherein, when facing outwardly, the shell of low visibility appears black in ambient light, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

5. A method for protecting a military or paramilitary firefighter or emergency worker, wherein the method comprises providing the military or paramilitary firefighter or emergency worker with a protective garment, which is a coat, trousers, overalls, or coveralls, which is reversible, which has a shell of high visibility and a shell of low visibility, and which is wearable with either shell facing outwardly while the other shell faces inwardly, wherein the shell of high visibility has portions that are reflective, fluorescent, or both, which portions face outwardly when the protective garment is worn so that the shell of high visibility faces outwardly, wherein, when facing outwardly, the shell of low visibility displays camouflage, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

6. The method of claim 5 wherein the shells are similar in basis weights.

7. The method of claim 5 wherein the shells are equal in basis weights.

8. A method for protecting a military or paramilitary firefighter or emergency worker, wherein the method is practiced by the military or paramilitary firefighter or emergency worker and comprises wearing a protective garment, which is a coat trousers, overalls, or coveralls, which is reversible, which has a shell of high visibility and a shell of low visibility, and which is wearable with either shell facing outwardly while the other shell faces inwardly, and wherein the shell of high visibility has portions that are reflective, fluorescent, or both, which portions face outwardly when the protective garment is worn so that the shell of high visibility faces outwardly, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

9. The method of claim 8 wherein those portions are provided by reflective trim affixed to the shell of high visibility.

10. A method for protecting a military or paramilitary firefighter or emergency worker, wherein the method is practiced by the military or paramilitary firefighter or emergency worker and comprises wearing a protective garment, which is a coat, trousers, overalls, or coveralls, which is reversible, which has a shell of high visibility and a shell of low visibility, and which is wearable with either shell facing outwardly while the other shell faces inwardly, wherein the shell of high visibility has portions that are reflective, fluorescent, or both, which portions face outwardly when the protective garment is worn so that the shell of high visibility faces outwardly, wherein, when facing outwardly, the shell of low visibility appears dark in ambient light, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

11. A method for protecting a military or paramilitary firefighter or emergency worker, wherein the method is practiced by the military or paramilitary firefighter or emergency worker and comprises wearing a protective garment, which is a coat, trousers, overalls, or coveralls, which is reversible, which has a shell of high visibility and a shell of low visibility, and which is wearable with either shell facing outwardly while the other shell faces inwardly, wherein the shell of high visibility has portions that are reflective, fluorescent, or both, which portions face outwardly when the protective garment is worn so that the shell of high visibility faces outwardly, wherein, when facing outwardly, the shell of low visibility appears black in ambient light, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

12. A method for protecting a military or paramilitary firefighter or emergency worker, wherein the method is practiced by the military or paramilitary firefighter or emergency worker and comprises wearing a protective garment, which is a coat, trousers, overalls, or coveralls, which is reversible, which has a shell of high visibility and a shell of low visibility, and which is wearable with either shell facing outwardly while the other shell faces inwardly, wherein the shell of high visibility has portions that are reflective, fluorescent, or both, which portions face outwardly when the protective garment is worn so that the shell of high visibility faces outwardly, wherein, when facing outwardly, the shell of low visibility displays camouflage, each shell conforms to NFPA standards for outer shells of protective garments for firefighters, wherein, if a tactical situation, in which a need for low visibility overrides a need for high visibility, develops or is expected to develop, the military or paramilitary firefighter or emergency worker wearing the protective garment with the shell of high visibility facing outwardly and with the shell of low visibility facing inwardly is motivated to doff the protective garment, to reverse the protective garment, and to re-don the protective garment with the shell of low visibility facing outwardly and with the shell of high visibility facing inwardly.

13. The method of claim 12 wherein the shells are similar in basis weights.

14. The method of claim 12 wherein the shells are equal in basis weights.

* * * * *